US009186025B2

(12) United States Patent
Hyun et al.

(10) Patent No.: US 9,186,025 B2
(45) Date of Patent: Nov. 17, 2015

(54) UPRIGHT TYPE VACUUM CLEANER HAVING DUST COMPRESSION DEVICE

(71) Applicants: Kietak Hyun, Seoul (KR); Jaedal Lee, Seoul (KR)

(72) Inventors: Kietak Hyun, Seoul (KR); Jaedal Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 542 days.

(21) Appl. No.: 13/623,256

(22) Filed: Sep. 20, 2012

(65) Prior Publication Data

US 2013/0067681 A1 Mar. 21, 2013

(30) Foreign Application Priority Data

Sep. 20, 2011 (KR) ..... 10-2011-0094697

(51) Int. Cl.

| | |
|---|---|
| ***A47L 5/28*** | (2006.01) |
| ***A47L 9/00*** | (2006.01) |
| ***A47L 9/10*** | (2006.01) |
| ***A47L 9/16*** | (2006.01) |

(52) U.S. Cl.

CPC ..... *A47L 5/28* (2013.01); *A47L 9/0072* (2013.01); *A47L 9/108* (2013.01); *A47L 9/1658* (2013.01); *A47L 9/1683* (2013.01)

(58) Field of Classification Search

CPC ..... A47L 9/1683; A47L 5/28; A47L 9/1666; A47L 9/1691; A47L 9/127; A47L 9/0072; A47L 9/108; A47L 9/1658

USPC ..... 15/347, 348, 349, 350, 357, 359; 55/361, 417, 428

See application file for complete search history.

(56) References Cited

U.S. PATENT DOCUMENTS

| | | | | |
|---|---|---|---|---|
| 4,363,156 | A * | 12/1982 | Leinfelt | 15/327.1 |
| 2005/0144751 | A1 * | 7/2005 | Kegg et al. | 15/320 |
| 2008/0115309 | A1 * | 5/2008 | Pan et al. | 15/300.1 |

FOREIGN PATENT DOCUMENTS

| | | | |
|---|---|---|---|
| EP | 0 038 786 | A1 | 10/1981 |
| JP | 3476076 | B2 | 9/2003 |
| KR | 10-1996-0001803 | B1 | 2/1996 |
| KR | 10-2006-0031442 | A | 4/2006 |

OTHER PUBLICATIONS

Korean Notice of Allowance dated Sep. 26, 2013 issued in Application No. 10-2011-0094697 (with English translation).

* cited by examiner

*Primary Examiner* — Robert Scruggs
(74) *Attorney, Agent, or Firm* — Ked & Associates, LLP

(57) ABSTRACT

Disclosed is an upright type vacuum cleaner having a dust compression device which automatically compresses dust in a dust collection device during cleaning. The upright type vacuum cleaner includes a main body, a dust collection device provided in the main body and collecting dust, the dust compression device provided within the dust collection device, the size of the dust compression device being selectively changeable according to pressure change therein to compress dust within the dust collection device, a vacuum suction motor provided on the main body and forming vacuum suction pressure, and a flow passage switch device communicating the dust compression device selectively with the vacuum suction motor or the external atmosphere. The dust compression device selectively communicates with the vacuum suction motor or the external atmosphere, and may thus repeatedly compress dust in the dust collection device.

19 Claims, 13 Drawing Sheets

(a)

(b)

UPRIGHT TYPE VACUUM CLEANER HAVING DUST COMPRESSION DEVICE

This application claims the benefit of Korean Patent Application No. 10-2011-0094967, filed on Sep. 20, 2011, which is hereby incorporated by reference as if fully set forth herein.

BACKGROUND OF THE INVENTION

1. Field of the Invention

The present invention relates to an upright type vacuum cleaner having a dust compression device, and more particularly, to an upright type vacuum cleaner which automatically compresses dust in a dust collection device during cleaning.

2. Discussion of the Related Art

In general, a vacuum cleaner sucks dust and foreign substances scattered on a cleaned surface together with air using suction force generated from a suction motor mounted in a main body, and then filters dust and foreign substances out from air at the inside of the main body.

Vacuum cleaners having the above function may be divided into an upright type vacuum cleaner in which a suction nozzle serving as a suction hole of air is formed integrally with a main body, and a canister type vacuum cleaner in which a suction nozzle communicates with a main body through a connection pipe.

From among the two kinds of vacuum cleaners, an upright type vacuum cleaner, as disclosed in Korean Patent Laid-open Publication No. 10-2009-0088545, includes a main body in which a vacuum motor generating suction force is installed, a suction nozzle sucking dust and foreign substances from a cleaned surface to the inside of the main body using suction force generated from the vacuum motor, and a handle provided on the upper portion of the main body and gripped by a user so that the suction nozzle moves along the cleaned surface.

That is, when power is applied to the main body and the suction motor is driven, suction force is generated and air including dust and foreign substances on the cleaned surface is introduced into the suction nozzle by such suction force.

Then, the air introduced into the suction nozzle is introduced into the main body of the vacuum cleaner, and the dust and foreign substances are separated from the air within a dust separation device mounted in the main body using the cyclone theory.

The separated dust and foreign substances are collected within a dust collection device of the vacuum cleaner, and the air from which dust and foreign substances are separated is discharged to the outside of the main body through an air discharge unit.

In case of the conventional upright type vacuum cleaner, if it is desired to remove dust and other foreign substances collected in the dust collection device, a user separates the dust collection device from the main body and then sets the dust collection device upside down to remove the dust and foreign substances.

However, in this case, the dust and foreign substances in the dust collection device may be scattered and thus cause user inconvenience.

SUMMARY OF THE INVENTION

Accordingly, the present invention is directed to an upright type vacuum cleaner having a dust compression device that substantially obviates one or more problems due to limitations and disadvantages of the related art.

An object of the present invention is to provide an upright type vacuum cleaner which compresses dust collected in a dust collection device to reduce the volume of the dust, and thus enhances user convenience during removal of dust and other foreign substances.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an upright type vacuum cleaner includes a main body, a dust collection device provided in the main body and collecting dust, a dust compression device provided within the dust collection device, the size of the dust compression device being selectively changeable according to pressure change therein to compress dust within the dust collection device, a vacuum suction motor provided on the main body and forming vacuum suction pressure, and a flow passage switch device communicating the dust compression device selectively with the vacuum suction motor or the external atmosphere.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

The sizes or shapes of elements illustrated in the accompanying drawings may be exaggerated, omitted, or schematically illustrated for clarity and convenience of description. Further, terms specially defined in consideration of the configuration and function of the present invention may be varied according to the intention of a user or an operator or the custom. Definition of these terms is given based on the description of the present invention.

Further, the scope of the present invention should not be construed as limited to the embodiments set forth herein, and it will be apparent to those skilled in the art that various modifications and variations can be made in the present invention without departing from the spirit or scope of the invention.

Figure 1:
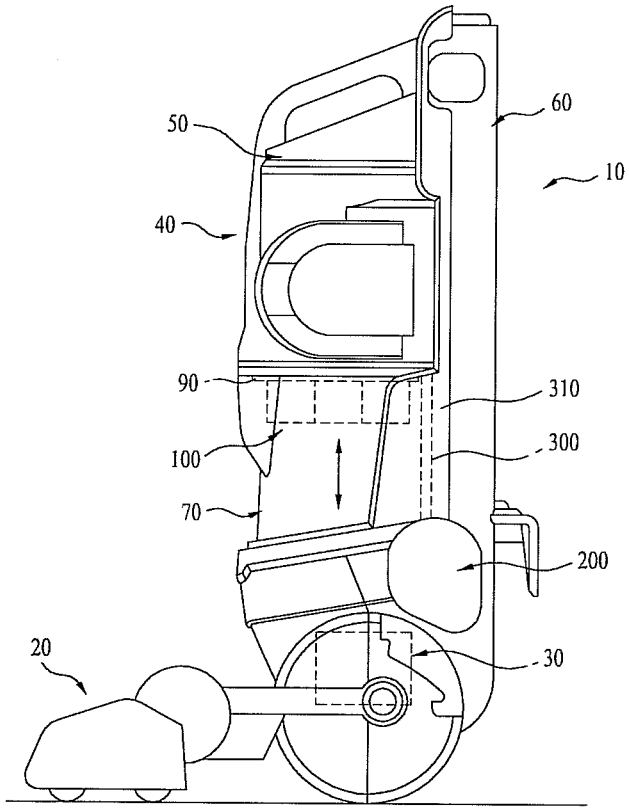
FIG. 1 is a side view of a vacuum cleaner in accordance with the present invention.

As shown in FIG. 1, an upright type vacuum cleaner in accordance with the present invention includes a main body 10 and a suction nozzle 20 provided in front of the main body 10.

The main body 10 includes a vacuum suction motor 30 generating vacuum suction pressure, a dust separation device 40 separating dust from sucked air using the vacuum suction pressure by rotating the air and dust, a filter device 50 provided above the dust separation device 40 to filter the air from which the dust is separated, a vacuum suction pipe forming a vacuum suction channel connecting the dust separation device 40 and the vacuum suction motor 30, and a dust collection device 70 communicating with the dust separation device 40 and collecting dust.

A dust compression device 100 to compress dust or foreign substances collected in the dust collection device 70 is provided within the dust collection device 70.

The dust compression device 100 is expanded or contracted according to air pressure change within the dust compression device 100, thus compressing dust or foreign substances.

If the dust compression device 100 communicates with the external atmosphere or the vacuum suction motor 30, the dust compression device 100 may be expanded or contracted.

In general, the pressure of the inside of the dust compression device 100 and the pressure of the inside of the dust collection device 70 are substantially the same.

Since the pressure of the inside of the dust collection device 70 or the pressure of the inside of the dust compression device 100 is lower than the external atmospheric pressure, when the dust compression device 100 communicates with the external atmosphere, air flows from the external atmosphere to the dust collection device 70.

Thereby, the dust compression device 100 may be expanded to compress dust or foreign substances therein.

On the contrary, since the pressure at the inside of the dust collection device 70 is higher than the pressure of a suction terminal of the vacuum suction motor 30, when the dust compression device 100 communicates with the vacuum suction motor 30, air flows from the dust compression device 100 to the vacuum suction motor 30.

Thereby, the dust compression device 100 may be contracted to release the compression state of dust or foreign substances.

The upright type vacuum cleaner further includes a guide pipe 300 communicating with the dust compression device 100 to guide movement of air and a flow passage switch device 200 connected to the guide pipe 300, so that the dust compression device 100 may communicate with the vacuum suction motor 30 or the external atmosphere.

A cover 90 including a designated guide channel 91 is provided on the dust compression device 100, and the guide channel 91 of the cover 90 is connected to the guide pipe 300 and the inside of the dust compression device 100 under the condition that the guide channel 91 communicate with both the guide pipe 300 and the inside of the dust compression device 100.

The flow passage switch device 200 selectively communicates the guide pipe 300 with the external atmosphere or the vacuum suction motor 30 under the condition that the flow passage switch device 200 is connected to the guide pipe 300.

Thereby, the external atmospheric pressure or the vacuum suction pressure may affect the inside of the dust compression device 100, thus deforming the shape or size of the dust compression device 100.

The guide pipe 300 is provided at one side of the dust collection device 70. The guide pipe 300 may be covered with a separate side cover 310 so as not be exposed to the outside.

The flow passage switch device 200 is disposed at one side of the main body 10 so as to be exposed to the outside, but may be disposed within the main body 10 so as not to be exposed to the outside.

Figure 2:
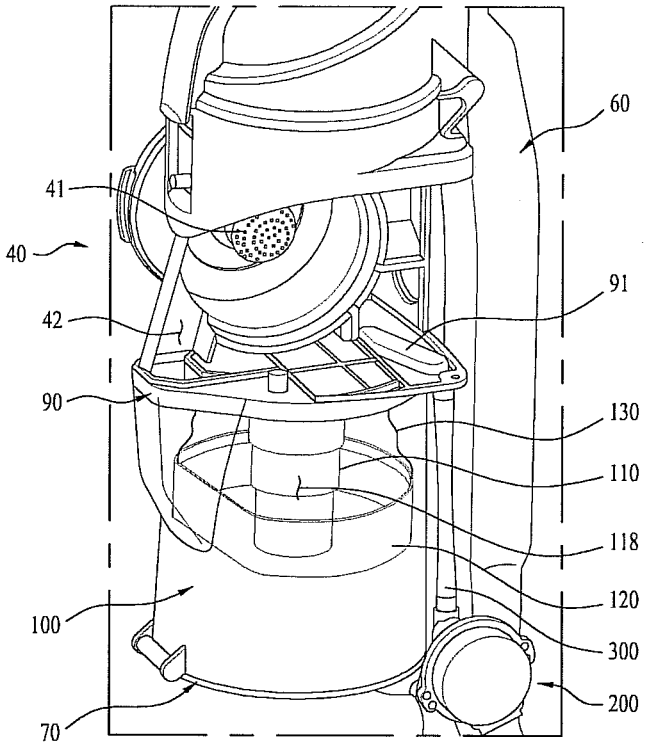
FIG. 2 is a perspective view illustrating the cross-section of a part of the vacuum cleaner in accordance with the present invention.

As shown in FIG. 2, the dust separation device 40 separates dust from air by the cyclone theory.

The dust separation device 40 includes an air discharge holes 41 provided at the side surface of the dust separation device 40, and a dust discharge hole 42 formed at the outer circumferential surface of the dust separation device 40.

The dust discharge hole 42 is extended downwardly and guides dust rotated along the inner circumferential surface of the dust separation device 40 to the outside of the dust separation device 40.

The dust discharge hole 42 may be connected to the upper portion of the dust collection device 70.

The cover 90 is provided between the dust separation device 40 and the dust collection device 70, and the guide channel 91 communicating with the dust compression device is provided on the cover 90.

The dust compression device 100 is provided below the cover 90, and is accommodated within the dust collection device 70.

The size or shape of the dust compression device 100 is deformable until the lower surface of the dust compression device 100 is adjacent to the bottom of the dust collection device 70.

The dust compression device 100 includes a guide member 110 provided on the lower surface of the cover 90, having a changeable length or shape to guide movement or shape deformation of the dust compression device 100, supporting the dust compression device 100 to fix the position of the dust compression device 100, a dust compression member 120 connected to the lower surface of the guide member 110, and a connection member 130 connecting the dust compression member 120 to the lower surface of the cover 90.

As the guide member 110, any member, the length of which may be increased or decreased and the volume of which may be expanded or contracted, may be used.

Although this embodiment illustrates a multi-stage pipe, the length of which is changeable, as the guide member 110, the disclosure is not limited thereto.

The connection member 130 connects the rim of the dust compression member 120 to the lower surface of the cover 90, thereby forming a closed surface in which the guide member 110 is accommodated.

The connection member 130 may be formed of a material, which reacts sensitively to shape change of the guide member 110 and thus has a size rapidly expanded or contracted, such as a soft synthetic resin, vinyl, a balloon or an elastic film.

An inner space 118 formed within the guide member 110 communicates with the guide channel 91 of the cover 90.

Therefore, air introduced by the guide channel 91 may rapidly enter the inner space 118 of the guide member 110 and increase the volume of the inner space 118 to extend or expand the guide member 110.

On the other hand, air in the inner space 118 of the guide member 110 may be rapidly discharged to the outside through the guide channel 91 and decrease the volume of the inner space 118 to shrink or contract the guide member 110.

The guide channel 91 may communicate with the closed space formed by the connection member 130 and the dust compression member 120.

Therefore, the volume of the closed space may be decreased by rapidly discharging air in the closed space to the outside through the guide channel 91, and may be increased to compress dust by introducing external air into the closed space through the guide channel 91.

The guide pipe 300 communicating with the guide channel 91 is provided at the edge of one side of the cover 90. The guide pipe 300 may be disposed vertically.

The flow passage switch device 200 is provided at the lower end of the guide pipe 300, and communicates the guide pipe 300 with the external atmosphere or the vacuum suction motor 30.

When the inner space 118 of the guide member 110 communicates with the external air by operation of the flow passage switch device 200, external air is introduced into the inner space 118.

On the other hand, when the inner space 118 of the guide member 110 communicates the vacuum suction motor 30 by operation of the flow passage switch device 200, air in the inner space 118 is discharged to the vacuum suction motor 30.

Figure 3:
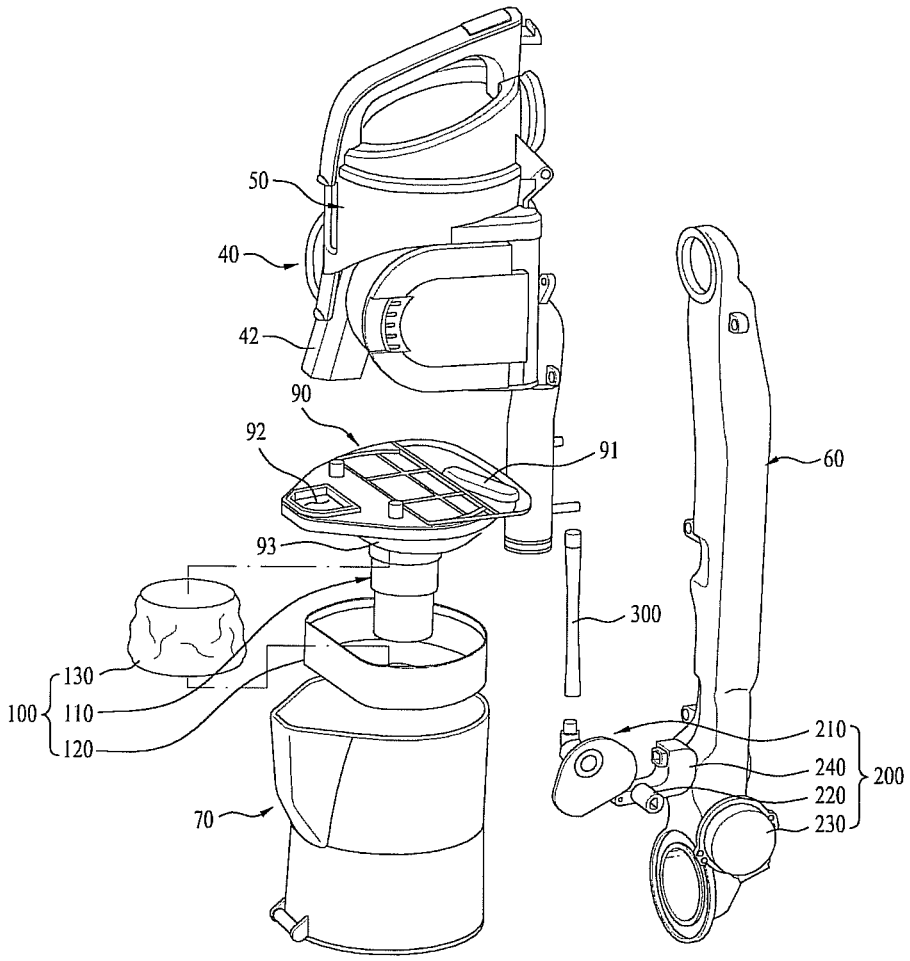
FIG. 3 is an exploded perspective view illustrating the part of the vacuum cleaner in accordance with the present invention.

As shown in FIG. 3, an insertion hole 92 into which the dust discharge hole 42 is inserted is formed at the front portion of the cover 90, and the guide channel 91 is protruded upwardly from the rear portion of the cover 90.

One end of the guide channel 91 is disposed at the inside of the cover 90, and the other end of the guide channel 91 is disposed adjacent to the edge of the cover 90.

One end of the guide channel 91 may communicate with the inside of the dust compression device 100, and the other end of the guide channel 91 may communicate with the guide pipe 300.

A support part 93 to which the upper portion of the connection member 130 is connected to support the connection member 130 is formed on the lower portion of the cover 90. The support member 93 may surround the guide member 110.

Through the above configuration, the support part together with the guide member 110 and the dust compression member 120 may form the closed space.

The guide member 110 may be a multi-stage pipe, the length of which is increased or decreased in the vertical direction, as described above.

Although a 3-stage pipe is illustrated as the guide member 110, the disclosure is not limited thereto.

The dust compression member 120 is provided in the shape of a case, the upper surface of which is opened, i.e., in the shape of a kind of bowl.

The bottom of the dust compression member 120 may correspond to the shape of the bottom of the dust collection device 70.

Since the bottom of the dust compression member 120 performs a dust compression action, such a shape of the bottom of the dust compression member 120 allows the dust compression action to be carried out throughout a wider area.

The lower end of the guide member 110 may be connected to the upper surface of the bottom of the dust compression member 120, and the guide member 110 may support the position of the dust compression member 120 and guide vertical movement of the dust compression member 120 by means of such connection.

The upper portion of the edge of the side surface of the dust compression member 120 is connected to the support part 93 provided on the cover by the connection member 130.

The upper edge of the connection member 130 is connected to the support part 93, and the lower edge of the connection member 130 is connected to the edge of the side surface of the dust compression member 120.

The flow passage switch device 200 includes a housing 210 connected to the guide pipe 300, a valve 220 rotatably provided within the housing 210, and a driving motor 230 rotating the valve 220.

A support surface is provided at one side of the housing 210, and the driving motor 230 is connected to the support surface. A connection housing 240 is provided at the rear of the housing 210.

The connection housing 240 serves to communicably connect the housing 210 to the vacuum suction pipe 60 forming the vacuum suction channel connected to the vacuum suction motor 30.

The upper portion of the vacuum suction pipe 60 is connected to the filter device 50 provided above the dust separation device 40, and the lower portion of the vacuum suction pipe 60 is disposed to face the vacuum suction motor 30 (with reference to FIG. 1).

Figure 4:
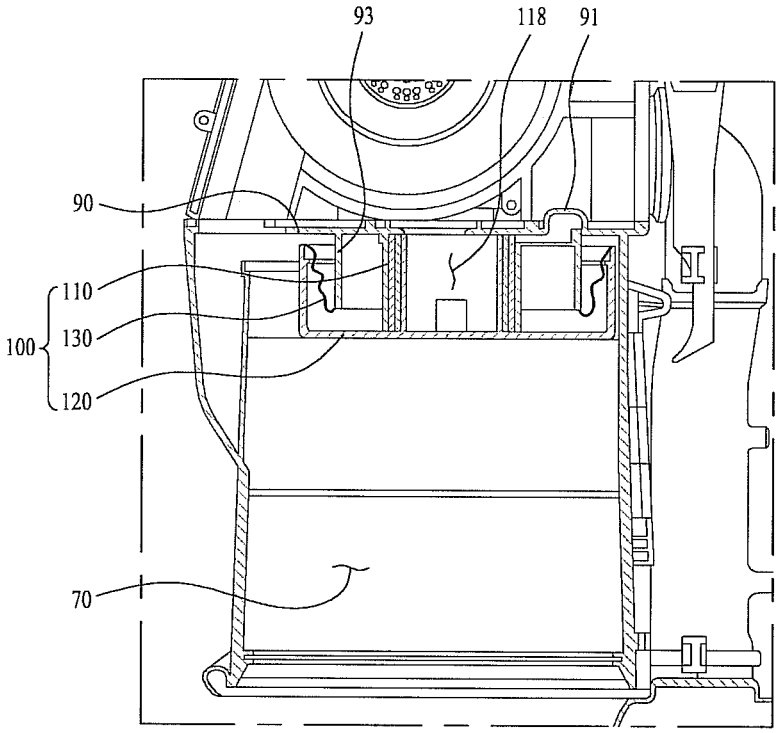
FIG. 4 is a longitudinal-sectional view of a dust compression device in a non-compression state.

As shown in FIG. 4, if the dust compression member 120 does not compress dust, the dust compression member 120 is disposed adjacent to the lower surface of the cover 90.

Further, the multi-stage pipe serving as the guide member 110 maintains an overlapped state so as to minimize the length of the guide member 110.

The connection member 130 maintains a minimized volume while connecting the support part 93 and the upper edge of the dust compression member 120.

During operation of the vacuum cleaner in accordance with the present invention, the dust compression member 120 is located above the dust collection device 70 when the inner space 118 of the guide member 110 and the vacuum suction motor 30 maintain a communicating state.

Such a communicating state is formed through the guide channel 91, the guide pipe 300 (with reference to FIG. 3) connected to the guide channel 91 and the flow passage switch device 200 (with reference to FIG. 3).

Figure 5:
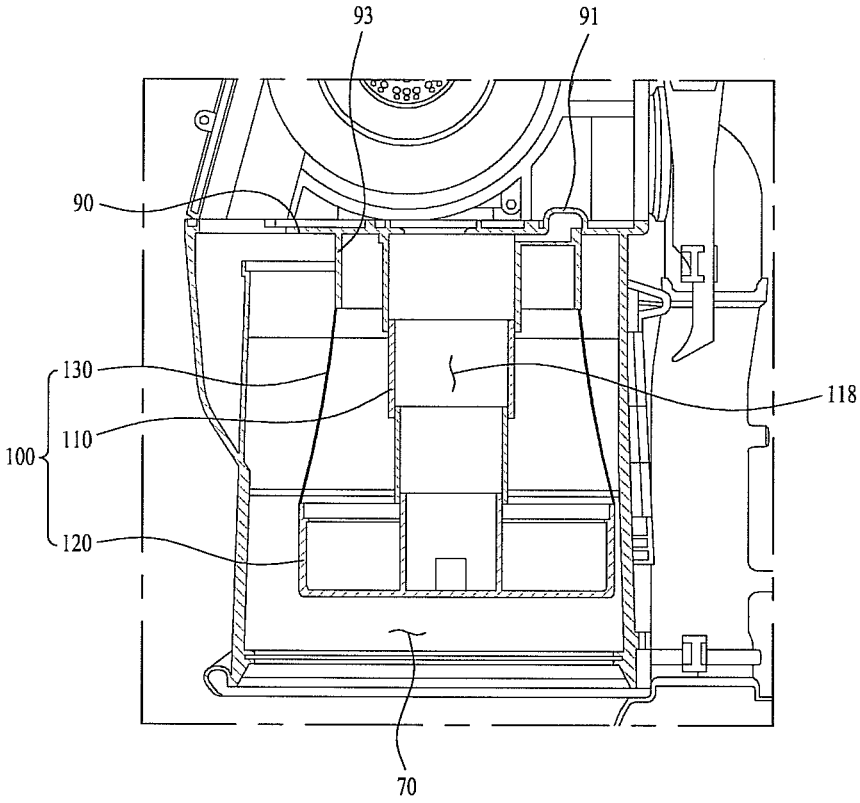
FIG. 5 is a longitudinal-sectional view of the dust compression device in a compression state.

As shown in FIG. 5, if the dust compression member 120 compresses dust, the dust compression member 120 descends and is disposed adjacent to the bottom of the dust collection device 70.

The length of the multi-stage pipe serving as the guide member 110 is maximally extended.

The connection member 130 maintains a maximized volume while connecting the support part 93 and the upper edge of the dust compression member 120.

The maximally descent position of the dust compression member 120 may be a position which maintains a state separated from the bottom of the dust collection device 70 by a designated interval, and dust located within such a separation space may be compressed.

During operation of the vacuum cleaner in accordance with the present invention, the dust compression member 120 is located above the dust collection device 70 when the inner space 118 of the guide member 110 and the vacuum suction motor 30 maintain the communicating state.

Figure 6:
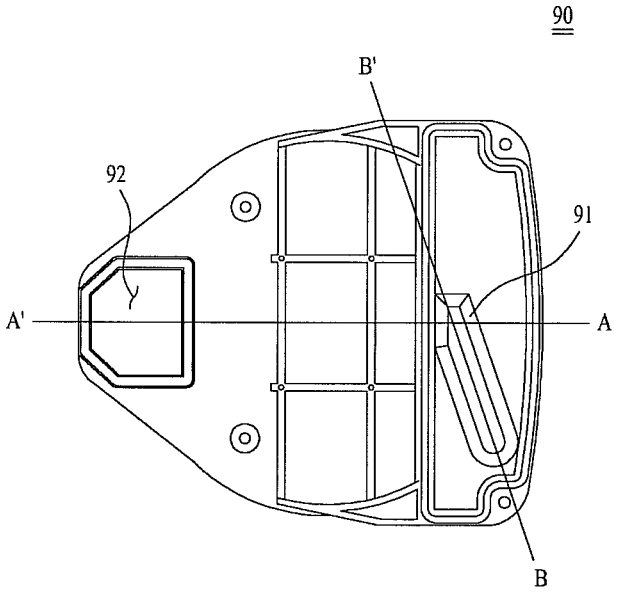
FIG. 6 is a transversal-sectional view of a cover of the vacuum cleaner in accordance with the present invention.

FIG. 6 is a plan view of the cover 90.

The insertion hole 92 into which the dust discharge hole 42 of the dust separation device 40 is inserted is formed at the front portion of the cover 90, and the guide channel 91 is formed at the rear portion of the cover 90.

Although the guide channel 91 is illustrated as being extended in a diagonal direction from the inside of the cover 90 to the edge of the cover 90, the disclosure is not limited to such a shape of the guide channel 91.

Figure 7:
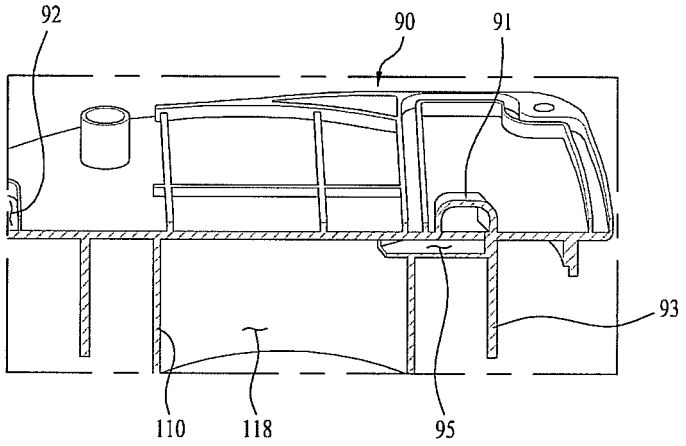
FIG. 7 is a perspective view illustrating the cross-section taken along the line A-A' of FIG. 6.

FIG. 7 is a perspective view illustrating the cross-section taken along the line A-A' of FIG. 6.

The support part 93 to which the connection member 130 is connected is extended downwardly from the lower surface of the cover 90. The support part 93 is formed in the shape of a wall having a designated height.

One end of the guide channel 91 communicates with the inner space 118 of the guide member 110.

A subsidiary channel 95 guiding air flow is provided between the end of the guide channel 91 and the guide member 110. The subsidiary channel 95 may be extended horizontally in a direction from the end of the guide channel 91 to the upper end of the guide member 110.

The uppermost pipe part of the multi-stage pipe serving as the guide member 110 is connected to the lower surface of the cover 90. The subsidiary channel 95 communicates with the upper end of the uppermost pipe part.

Figure 8:
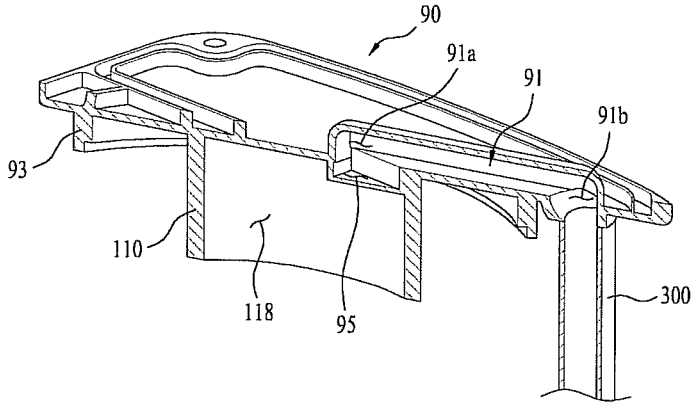
FIG. 8 is a perspective view illustrating the cross-section taken along the line B-B' of FIG. 6.

FIG. 8 is a perspective view illustrating the cross-section taken along the line B-B' of FIG. 6.

One end 91*a* of the guide channel 91 communicates with the inner space 118 of the guide member 110, as described above, and the other end 91*b* of the guide channel 91 communicates with the guide pipe 300.

Therefore, when the inner space 118 of the guide member 110 communicates with the vacuum suction motor 30, air in the inner space 118 may be discharged via the guide channel 91 and the guide pipe 300, and thus the length of the guide member 110 may be decreased.

On the other hand, when the inner space 118 of the guide member 110 communicates with the external atmosphere, air of the external atmosphere may be introduced into the inner space 118 of the guide member 110 via the guide channel 91 and the guide pipe 300, and thus the length of the guide member 110 may be increased.

Figure 9:
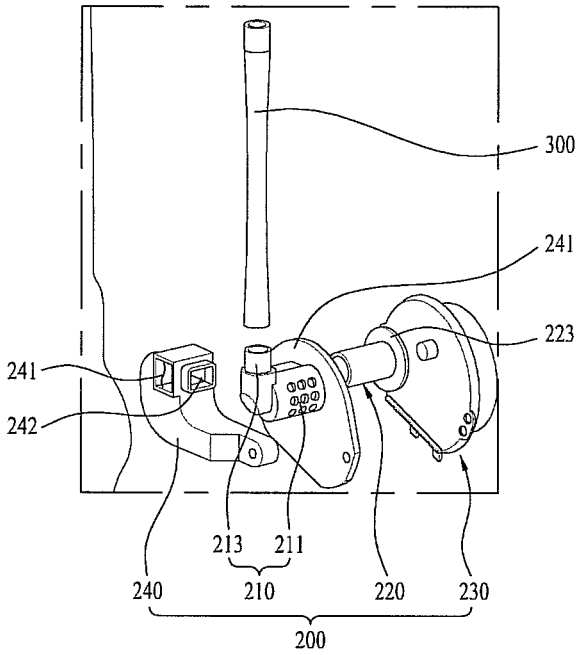
FIGS. 9(*a*) and 9(*b*) and FIG. 10 are exploded perspective views of a flow passage switch device of the vacuum cleaner in accordance with the present invention.
Figure 9:
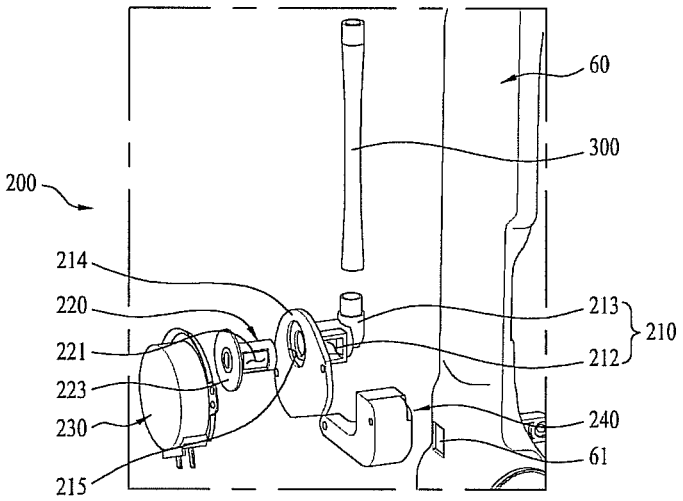

FIG. 9(*a*) is a front perspective view of the flow passage switch device 200, and FIG. 9(*b*) is a rear perspective view of the flow passage switch device 200.

As shown in FIGS. 9(*a*) and 9(*b*), the flow passage switch device 200 includes the housing 210 connected to the guide pipe 300, the cylindrical valve 220 inserted into the housing 210, the driving motor 230 connected to the valve 220 and rotating the valve 220, and the connection housing 240 connecting the housing 210 and the vacuum suction pipe 60.

A connection pipe 213 connected to the guide pipe 300 is provided at one side of the housing 210.

First holes 211 communicating with the external atmosphere are provided in one direction on the outer circumferential surface of the housing 210, and a second hole 212 communicating with the connection housing 240 is provided in the other direction.

Plural first holes 211 are separated from each other, and the second hole 212 is formed in the shape of a rectangular opening but the second hole 212 may have various shapes.

A connection plate 214 connected to the driving motor 230 is provided on the housing 210, and a receipt groove 215 on which a support plate 223 provided on the valve 220 is received is provided on the connection plate 214.

A first communication hole 241 into which the vacuum suction pipe 60 is inserted to communicate with the vacuum suction pipe 60 and a second communication hole 242 connected to the second hole 212 to communicate with the second hole 212 are provided on the connection housing 240.

A connection hole 61 into which the rim of the first communication hole 241 is inserted is provided on the vacuum suction pipe 60.

Although the first communication hole 241 and the second communication hole 242 are disposed to be perpendicular to each other, the disclosure is not limited thereto.

The valve 220 may be formed in a cylindrical shape, and be rotatably inserted into the housing 210.

A communication hole 221 communicable with the first holes 211 and the second hole 212 is provided on the outer circumferential surface of the valve 220.

Figure 10:
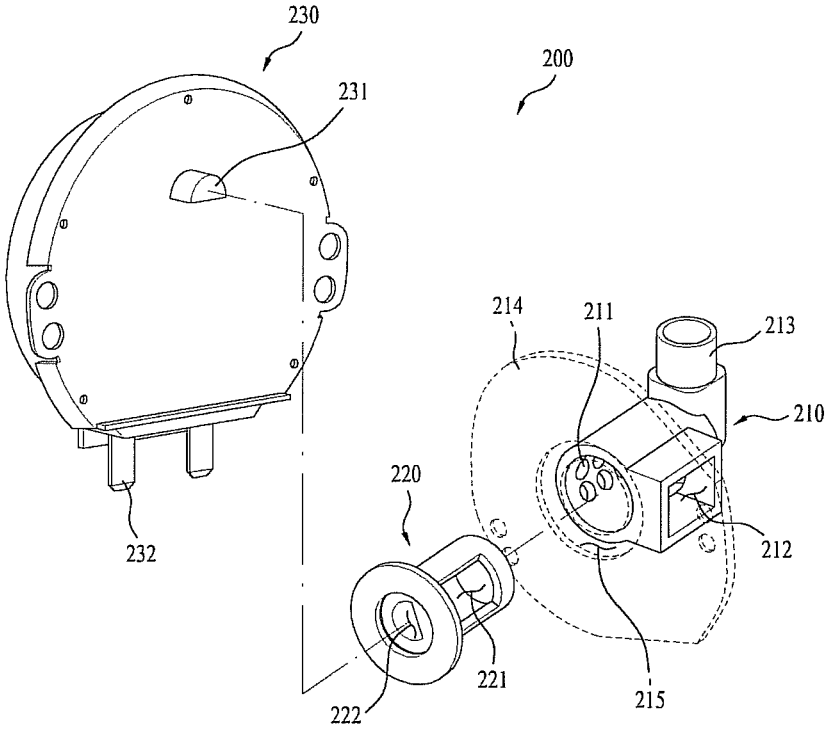

As shown in FIG. 10, the cross-section of a rotary shaft 231 of the driving motor 230 is provided in a non-circular shape.

Although FIG. 10 illustrates the rotary shaft 231 as having a semicircular cross-section, the disclosure is not limited thereto.

A terminal unit 232 to which power is supplied is provided at the lower portion of the driving motor 230.

One side of the valve 220 is opened, and an insertion hole 222 into which the rotary shaft 231 is inserted is formed at other side of the valve 220. The insertion hole 222 may be formed in a shape corresponding to the shape of the cross-section of the rotary shaft 231.

The valve 220 is provided in a cylindrical shape, as described above, and the inside of the valve 220 is vacant. The communication hole 221 provided in a rectangular shape or other shapes is disposed on the outer circumferential surface of the valve 220.

The width of the communication hole 221 in the lateral direction may be slightly smaller than the width of the valve 220 in the lateral direction, and correspond to the width of the first and second holes 211 and 212 provided on the housing 210.

The support plate 223 is provided at the side of the valve 220 where the insertion hole 222 is formed. The diameter of the support plate 223 is greater than the outer diameter of the valve 220.

The support plate 223 serves as a projection preventing the valve 220 from excessively deeply entering the housing 210.

The support plate 223 is accommodated in and supported by the receipt groove 215 provided on the connection plate 214, as described above.

The rim of the second hole 212 provided on the housing 210 may be extended in the moving direction of air, and the plural small-sized first holes 211 may be separated from each other.

The reason for preparation of the plural small-sized first holes 211 is to prevent foreign substances more than a designated size from being introduced into the housing 210.

Further, the reason for extension of the rim of the second hole 212 is to achieve easy connection with the connection housing 240.

The connection pipe 213 extended upwardly so as to be connected to the guide pipe 300 is provided at one side of the housing 210 where the first and second holes 211 and 212 are disposed.

The connection pipe 213 may communicate with the first holes 211 or the second hole 212 through the valve 220.

Figure 11:
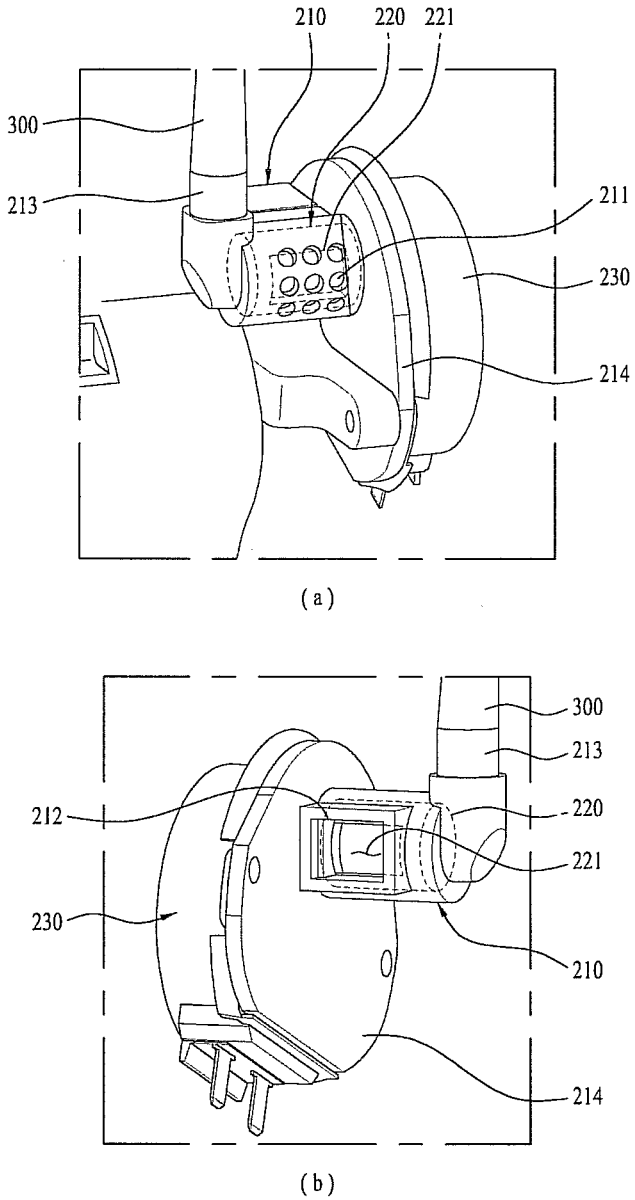
FIGS. 11(*a*) and 11(*b*) are perspective views of the flow passage switch device of the vacuum cleaner in accordance with the present invention in an assembled state.

FIG. 11(*a*) illustrates a state in which the communication hole 221 of the valve 220 communicates with the first holes 211 by operation of the driving motor 230.

When the communication hole 221 of the valve 220 becomes opposite to the first holes 211, external air communicates with the connection pipe 213 and the guide pipe 300 via the first holes 211, the communication hole 221 of the valve 220 and the inner space of the valve 220.

Therefore, when the vacuum cleaner is operated to drive the vacuum suction motor 30, external air may move toward the guide member 110 within the dust collection device 70 by pressure gradient and thus the guide member 110 may be expanded or extended.

FIG. 11(*b*) illustrates a state in which the communication hole 221 of the valve 220 communicates with the second hole 212 by operation of the driving motor 230.

When the communication hole 221 of the valve 220 becomes opposite the second hole 212, the inside of the vacuum suction channel communicates with the connection pipe 213 and the guide pipe 300 via the second hole 212, the communication hole 221 of the valve and the inner space of the valve 220.

Therefore, when the vacuum cleaner is operated to drive the vacuum suction motor 30, air in the guide member 110 in the dust collection device 70 may move to the vacuum suction channel by pressure gradient and thus the guide member 110 may be contracted or shrunk.

Hereinafter, operation of the upright type vacuum cleaner in accordance with the present invention will be described with reference to the accompanying drawings.

Figure 12:
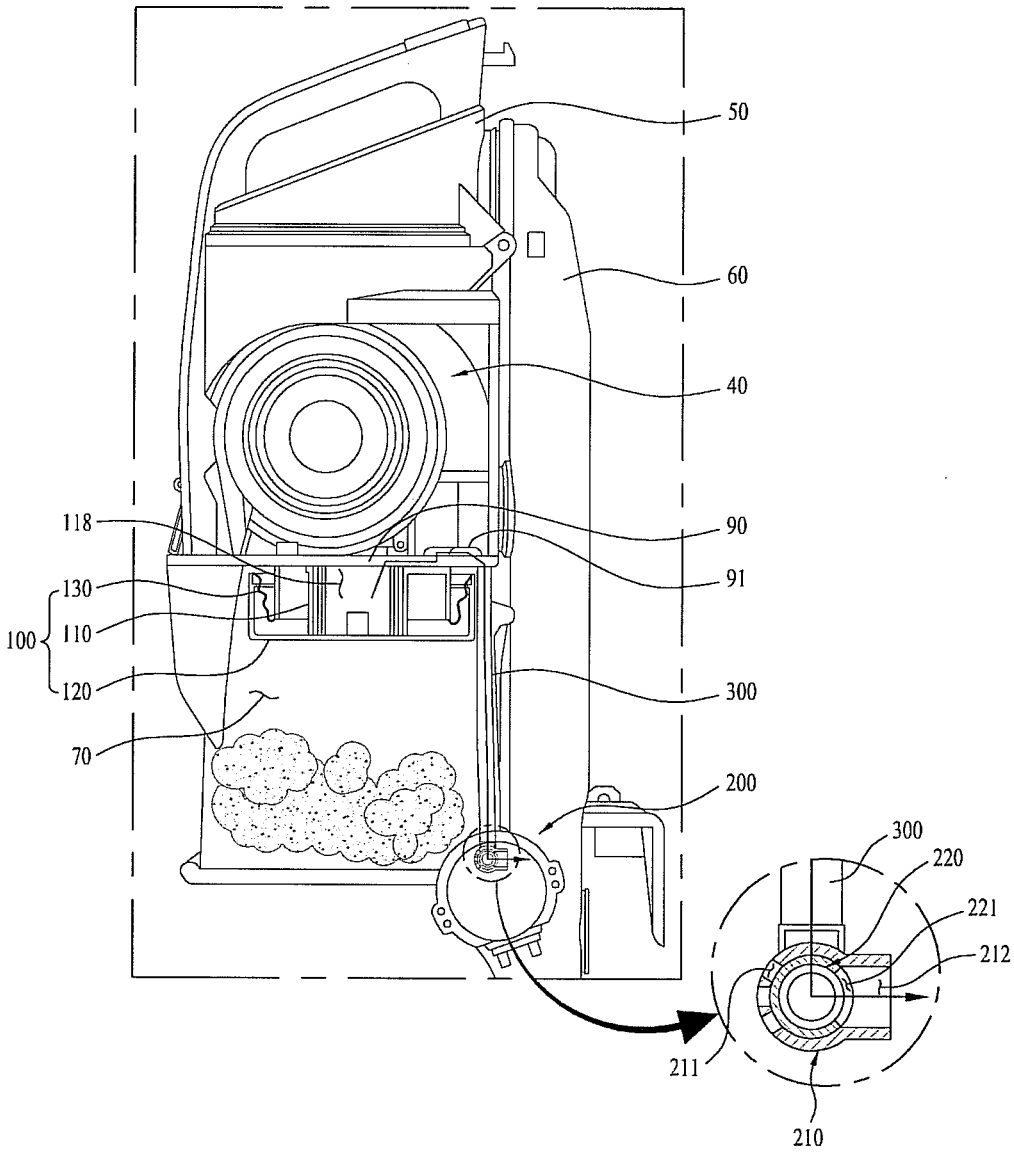
FIG. 12 is a longitudinal-sectional view illustrating air flow during non-compression in the vacuum cleaner in accordance with the present invention.

As shown in FIG. 12, when the vacuum cleaner in accordance with the present invention is turned on, the vacuum suction motor 30 (with reference to FIG. 1) is operated and vacuum suction pressure generated thereby is applied to the dust collection device 70 and the dust separation device 40.

Therefore, air and dust around the suction nozzle (with reference to FIG. 1) move to the dust separation device 40 via the suction nozzle 20.

Air and dust having moved to the dust separation device 40 are separated from each other by centrifugal force.

Air reaches the vacuum suction motor 30 (with reference to FIG. 1) via the filter device 50 provided above the dust separation device 40 and the vacuum suction pipe 60, and is then discharged to the outside of the main body 10.

On the other hand, dust separated from air by the dust separation device 40 is collected in the dust collection device 70. Dust and other foreign substances collected in the dust collection device 70 are in a non-compression state due to the nature thereof.

When the communication hole 221 of the valve 220 communicates with the second hole 212 by the driving motor 230 of the flow passage switch device 200, the inner space 118 of the guide member 110 and the vacuum suction pipe 60 communicate with each other.

In this case, the pressure of the inside of the vacuum suction pipe 60 is lower than the pressure of the inside of the guide member 110, and thus air flows in a direction from the guide member 110 to the vacuum suction pipe 60 as shown by an arrow of FIG. 12.

Therefore, the guide member 110 is maximally shrunk or contracted.

Figure 13:
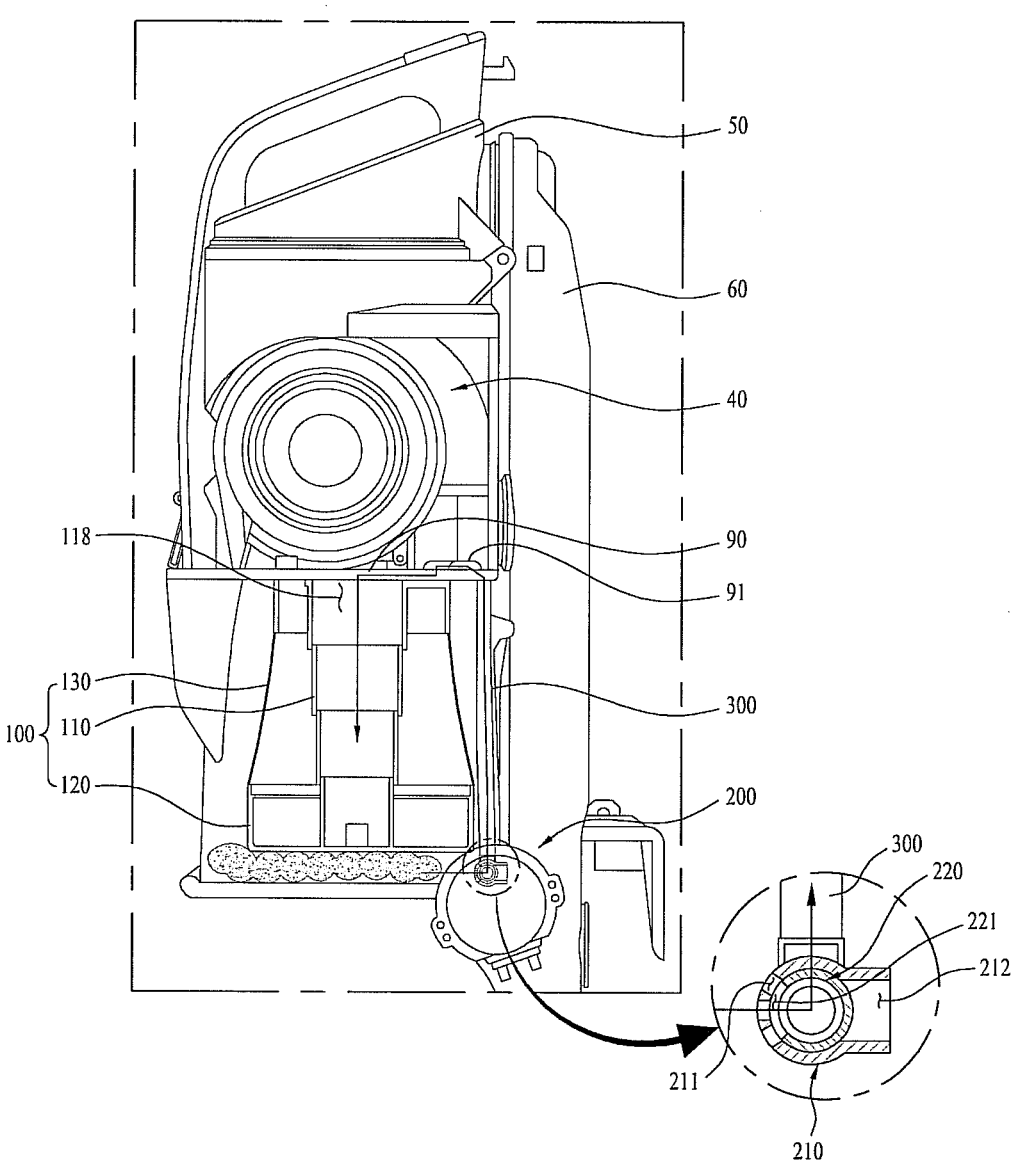
FIG. 13 is a longitudinal-sectional view illustrating air flow during compression in the vacuum cleaner in accordance with the present invention.

As shown in FIG. 13, the driving motor 230 may be operated during operation of the vacuum cleaner in accordance with the present invention, thus rotating the valve 220 by an angle of 180 degrees from the state of FIG. 12.

In this case, external air and the inner space 118 of the guide member 110 communicate with each other by the first holes 211, the valve 220 and the guide pipe 300.

The pressure of the inside of the guide member 110 is greatly lower than the pressure of the external air, and thus air flows in a direction from the outside of the main body 10 to the inner space 118 of the guide member 110.

Therefore, the inside of the guide member 110 is expanded, and thus the guide member 110 is expanded or extended. Consequently, the lower end of the guide member 110 and the dust compression member 120 connected to the guide member 110 descend.

When the valve 220 is momentarily rotated, the state in which air is discharged from the guide member 110 is momentarily changed to the state in which air is introduced into the guide member 110.

Thereby, the guide member 110 is immediately expanded or extended, and compression of dust by the dust compression member 120 is immediately carried out.

By such an action, dust accumulated at the lower portion of the dust collection device 70 may be compressed by the dust compression member 120, and thus the volume of the dust may be greatly reduced as compared to the state of FIG. 12.

When the driving motor 230 rotates the valve 220 again so that the inner space of the guide member 110 communicates with the second hole 212, the guide member 110 is contracted or shrunk, the dust compression member 120 ascends, and the vacuum cleaner is returned to the state of FIG. 12.

Therefore, dust compression and release of dust compression may be repeatedly carried out through the above-described rotation of the valve 220.

After completion of cleaning, if a user separates the dust collection device 70 from the main body 10 to remove dust from the inside of the dust collection device 70, formation of scattered dust may be reduced as compared to the case in which dust is not compressed.

As apparent from the above description, in an upright type vacuum cleaner in accordance with the present invention, a dust compression device communicates selectively with a vacuum suction motor or the external atmosphere, and may thus repeatedly compress dust within a dust collection device.

Particularly, the dust compression device includes a guide member being vertically expandable and contractible and a dust compression member connected to the guide member, and may thus more stably compress dust and other foreign substances.

Since the guide member is installed on the lower surface of a cover, the position of the guide member may be stably maintained.

Since the guide member is a multi-stage pipe, expansion and contraction of the guide member may be more rapidly and stably achieved.

Since the dust compression member and the cover may be connected by an elastically expandable and contractible connection member, the position of the dust compression member may be stably maintained.

Since a guide channel guiding introduction of air to the guide member or guiding discharge of air from the guide member is provided on the cover and is connected to a flow passage switch device by a guide pipe, air may be rapidly and stably introduced into or discharged from the guide member.

The flow passage switch device includes a circular valve, a housing and a driving motor, the inside of the guide member easily communicates with the external atmosphere or a vacuum suction channel by operation of the driving motor, and the communication state is momentarily changed, thereby achieving more rapid dust compression.

Particularly, since the valve is rotated by the continuous operation of the driving motor and dust compression and release of dust compression is repeatedly accomplished by the rotation of the valve, dust in the dust collection device may be more reliably compressed.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. An upright type vacuum cleaner comprising:

a main body;

a dust collection device provided in the main body that collects dust;

a dust compression device provided within the dust collection device, the size of the dust compression device being selectively changeable according to pressure change therein to compress dust within the dust collection device;

a vacuum suction motor provided on the main body that forms vacuum suction pressure; and a flow passage switch device communicating the dust compression device selectively with the vacuum suction motor or external atmosphere, wherein the dust compression device includes:

a guide member having a changeable length or shape that guides dust compression; and a dust compression member disposed adjacent to the guide member that is vertically movable within the dust collection device according to a change of the length or shape of the guide member.

2. The upright type vacuum cleaner according to claim 1, further comprising a cover provided above the dust collection device having the dust compression device mounted thereon, wherein a guide channel communicating with the inside of the dust compression device that guides air flow is provided on the cover.

3. The upright type vacuum cleaner according to claim 2, wherein the dust compression device further includes a connection member connecting the lower portion of the cover to the dust compression member.

4. The upright type vacuum cleaner according to claim 3, wherein the connection member is formed of a material, the size of which is expandable and contractible according to length or shape change of the guide member and movement of the compression member.

5. The upright type vacuum cleaner according to claim 2, wherein the guide member is connected to the dust compression member.

6. The upright type vacuum cleaner according to claim 5, wherein the guide member is a multi-stage pipe, the length of which is increased or decreased.

7. The upright type vacuum cleaner according to claim 6, wherein the multi-stage pipe includes a plurality of pipe parts, the diameters of which are gradually reduced in the downward direction, wherein the uppermost pipe part of the multi-stage pipe is connected to the cover and the lowermost pipe part is connected to the dust compression member.

8. The upright type vacuum cleaner according to claim 2, wherein the guide channel is communicable with the inner space of the guide member and guiding influx and efflux of air into and from the inner space.

9. The upright type vacuum cleaner according to claim 8, further comprising a subsidiary channel connecting the guide channel and the inner space of the guide member.

10. The upright type vacuum cleaner according to claim 2, further comprising a guide pipe connecting the flow passage switch device and the guide channel.

11. The upright type vacuum cleaner according to claim 10, wherein one end of the guide pipe is mounted on the lower surface of the cover and is communicable with the guide channel, and the other end of the guide pipe is communicable with the flow passage switch device.

12. The upright type vacuum cleaner according to claim 2, wherein the flow passage switch device includes:

a housing communicable with the external atmosphere or the vacuum suction motor; and a valve rotatably provided within the housing and communicating the dust compression device with the external air or the vacuum suction motor.

13. The upright type vacuum cleaner according to claim 12, wherein the flow passage switch device further includes a driving motor rotating the valve.

14. The upright type vacuum cleaner according to claim 13, further comprising:

a rotary shaft provided on the driving motor; and an insertion hole provided at the other end of the valve, wherein the rotary shaft is inserted into the insertion hole.

15. The upright type vacuum cleaner according to claim 12, further comprising:

a vacuum suction pipe communicating with the vacuum suction motor and provided at one side of the main body; and a connection housing communicating the vacuum suction pipe and the housing with each other.

16. The upright type vacuum cleaner according to claim 12, wherein the valve is provided in the shape of a hollow pipe, one end of which is opened and the inside of which is vacant, and a communication hole communicating with the inside of the valve is provided on the outer circumferential surface of the valve.

17. The upright type vacuum cleaner according to claim 16, wherein:

the opened end of the valve communicates with the dust compression device; and the communication hole is communicable with the external atmosphere or the vacuum suction pipe according to rotation of the valve.

18. The upright type vacuum cleaner according to claim 12, wherein the housing includes:

a first hole communicating with the external atmosphere; and a second hole communicating with the vacuum suction motor.

19. An upright type vacuum cleaner comprising:

a main body;

a dust collection device provided in the main body that collects dust;

a dust compression device having the size being selectively changeable according to pressure change therein to compress dust within the dust collection device;

a vacuum suction motor provided on the main body that forms vacuum suction pressure; and a flow passage switch device communicating the dust compression device selectively with the vacuum suction motor or external atmosphere, wherein the flow passage switch device has a valve communicating the dust compression device with the external air or the vacuum suction motor, wherein the dust compression device retracts when the flow passage switch device allows the dust compression device to communicate with the vacuum suction motor and wherein the dust compression device expands when the flow passage switch device allows the dust compression device to communicate with the external atmosphere.

* * * * *